United States Patent [19]

Nash

[11] 4,333,391

[45] Jun. 8, 1982

[54] ADJUSTABLE SPRING-RETURN ACTUATOR

[76] Inventor: Alan R. B. Nash, 39 Abbott's Ride, Farnham, Surrey, England

[21] Appl. No.: 126,128

[22] Filed: Feb. 29, 1980

[30] Foreign Application Priority Data

Mar. 2, 1979 [GB] United Kingdom ..... 7907453

[51] Int. Cl.[3] ..... F01C 9/00; F01B 31/00

[52] U.S. Cl. ..... 92/121; 92/130 B; 267/177

[58] Field of Search ..... 92/130 B, 130 R, 120–125; 267/175, 177, 62

[56] References Cited

U.S. PATENT DOCUMENTS

| | | | |
|---|---|---|---|
| 1,250,569 | 12/1917 | Desmond | 92/120 |
| 2,250,035 | 7/1941 | Price | 92/122 |
| 2,316,356 | 4/1943 | Nette et al. | 92/122 |
| 2,679,240 | 5/1954 | Ong et al. | 92/121 |

FOREIGN PATENT DOCUMENTS

| | | | |
|---|---|---|---|
| 1270941 | 4/1972 | United Kingdom | 92/121 |

*Primary Examiner*—Paul E. Maslousky

*Attorney, Agent, or Firm*—Hopgood, Calimafde, Kalil, Blaustein & Judlowe

[57] ABSTRACT

A pressure-fluid operated actuator with a vane pivoting in a casing has a biasing spring in a two-part housing attached at one end to one part of the housing and at the other end to the vane. To adjust the spring bias said one housing part is rotatable by a worm and wormwheel mechanism. The worm is carried by said one housing part. The other housing part is fixed to the casing and has the wormwheel integrally formed on it. The wormwheel teeth are quadrant-form with an end face in a plane normal to the vane pivot axis and containing the worm axis so that the housing parts can be die cast or moulded and can be brought together axially to intermesh the worm and wormwheel. The transverse force on the worm is transmitted through its toothing to its housing part.

11 Claims, 4 Drawing Figures

FIG. 2
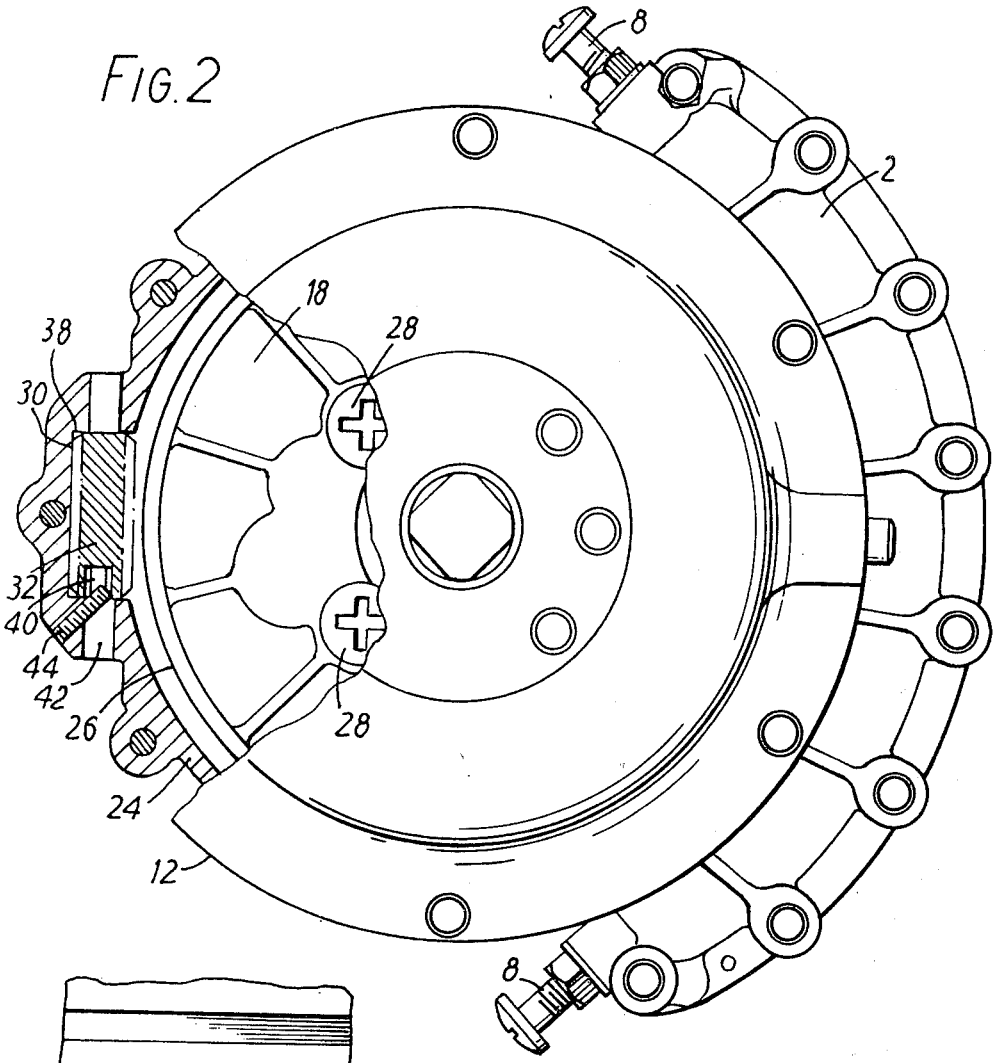
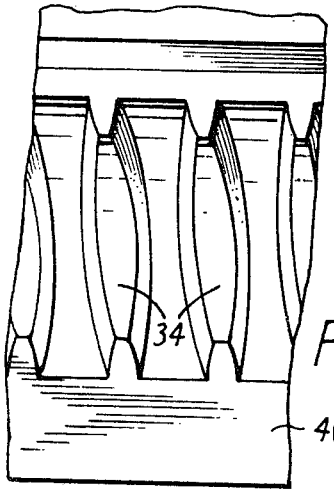
FIG. 3a
FIG. 3b
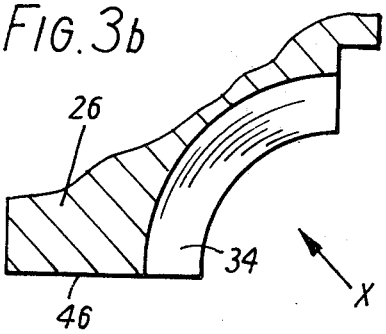

ADJUSTABLE SPRING-RETURN ACTUATOR

BACKGROUND OF THE INVENTION

This invention relates to pressure-fluid operated actuators provided with biasing spring means.

In a known actuator (British Pat. No. 1,270,941) a vane is pivotally mounted in a fluid pressure chamber in a casing and a return or bias spring acts on the vane so that it is urged to one end position from which it can be displaced by fluid pressure applied to one side of it. The biasing spring is carried in a housing that is detachably secured to the casing and the spring torque can be adjusted by releasing the housing and rotating it relative to the casing.

This procedure, in actuators of the sizes commonly used for industrial applications at least, is not easy and can be dangerous because of the amount of energy that must be stored in the spring. Control of the adjustment is difficult because of the need to detach the spring housing from the actuator casing and levers must be used to hold the housing steady and to rotate it manually to wind up the spring. These factors bring the risk of injury to the user and damage to the actuator. If adjustment is to be made after the actuator has been installed, difficulty of access may make it necessary to remove it to carry out the adjustment.

It is known to use a worm and wormwheel mechanism to wind up a coiled spring. Such worm drives are disclosed in U.K. Pat. Nos. 320,400 and 290,954. There is also known, from U.K. Pat. No. 271,862, an arrangement for a typewriter carriage movement mechanism comprising a tension spring, which is adjusted through a worm drive from an electric motor. These known worm and wormwheel mechanisms are however relatively expensive to produce.

It is an object of the present invention to provide a worm and wormwheel adjustment mechanism for a spring-biased pivoted vane actuator that can be economically produced.

It is a further object to provide such a mechanism in which the production can be simplified by the use of die-cast or moulded parts that require little or no further machining.

SUMMARY OF THE INVENTION

In an actuator according to the invention the biasing spring is mounted in a housing comprising two die-cast or moulded parts that are, respectively, fixedly secured to the actuator casing in which the vane has an axis of rotation, and rotationally displaceable relative to the casing about said axis, the spring having one end fixed to the vane and another end fixed to the displaceable housing part for variation of the torque exerted by the spring on the vane by rotation of said displaceable part to an adjusted angular position, a worm and wormwheel mechanism for said rotation including a wormwheel element comprising teeth on one of the housing parts and a worm element carried by the other of the housing parts, an arcuate region of the worm being engaged by the wormwheel teeth, said region being non-symmetrically offset with respect to a plane normal to the axis of rotation of said displaceable housing part and containing the worm axis, the wormwheel teeth for engaging said region of the worm being formed integrally on its housing part in the diecasting or moulding of said part, whereby the worm and wormwheel elements are brought into mesh by relative movement of one housing part towards the other in the direction of said axis of rotation.

According to another aspect of the invention, there is provided a pressure-fluid operated actuator having a casing providing a pivot axis for a displaceable member that is rotatable about said axis under the action of a pressure fluid, a spiral spring being connected at one end to the displaceable member to bias it to an end position, and a worm and wormwheel mechanism mounted on the casing being connected to the spring for varying the biasing torque by movement of the other end of the spring about the pivot axis, the wormwheel element of said mechanism being disposed coaxially to said pivot axis and the arcuate extent of the teeth of the wormwheel element terminating substantially at or before the plane normal to said pivot axis that contains the rotary axis of the mechanism worm element, such that as seen in the direction of said pivot axis there is no radial overhang at either end of the arcuate extent of the individual teeth of the wormwheel element in a radial direction with respect to the major part of said arcuate extent.

The invention will be described in more detail, by way of example, with reference to the accompanying drawings.

BRIEF DESCRIPTION OF THE DRAWINGS

FIG. 2 is a top plan view of the actuator of FIG. 1, partly broken away, and FIG. 3*a* is a detail view to a larger scale of some of the wormwheel teeth on the spring housing base member of the actuator of FIGS. 1 and 2, as seen in the fragmentary axial sectional view of FIG. 3*b* in the direction of the arrow X at 45° to the wormwheel axis.

DESCRIPTION OF THE PREFERRED EMBODIMENT

Figure 1:
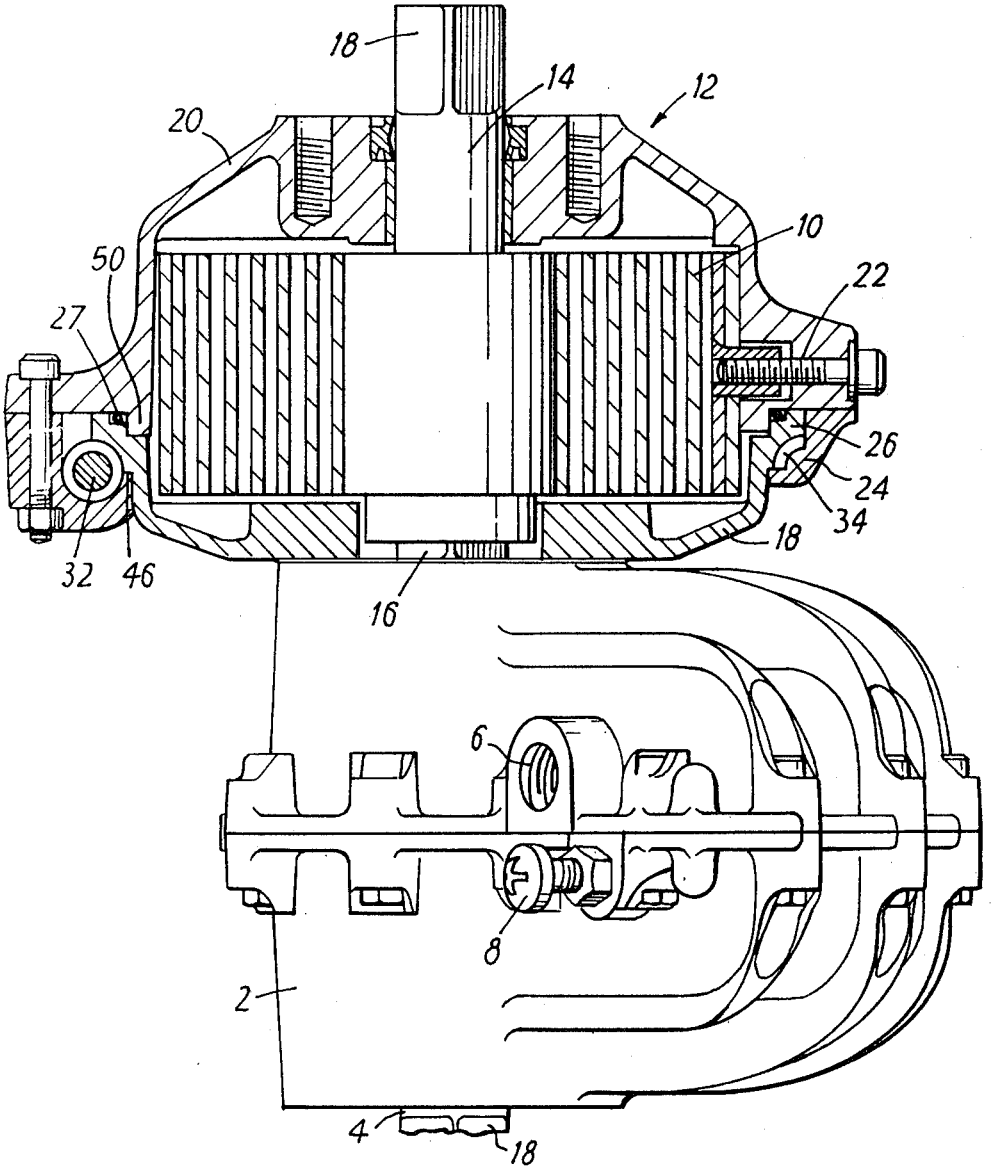
FIG. 1 is a partly sectioned side elevation of an actuator according to the invention.

Referring to the drawings, the actuator comprises a main casing 2 of generally known form in which a shaft 4 is rotatably mounted to rotate about a pivot axis. The casing interior provides an arcuate pressure fluid chamber in which there is located a displaceable member in the form of a vane (not shown) fixed to the pivot shaft 4 to be able to rotate on said axis through some 90° between opposite end positions. At opposite ends the chamber is provided with tappings 6 for alternative pressure fluid connections to displace the vane and screwed end stops 8 are provided to adjust the end limits of the vane displacement. In these respects reference can be made to said British Pat. No. 1,270,941 for further details of the construction.

The vane can also be displaced by a spiral biasing spring 10 which urges the vane to one end position. The spring is mounted in housing 12 in which an auxiliary shaft 14 is journalled coaxially with the main pivot shaft 4, the two shafts being rotationally secured together by a square spigot and socket engagement 16 between them. Both shafts have square spigots 17 projecting from opposite ends of the casing and the housing for the connection of further members (not shown), such as a valve or other device to be operated by the actuator, and there are also tapped holes provided adjacent these projecting spigots for securing such devices to the actuator.

The spring housing 12 comprises a base member 18 of generally dished form providing a first part of the housing, a cover member 20 to which the outer end of the spring is secured by a bolt 22, and a retaining ring 24 that fits under a peripheral flange 26 of the base member and is bolted at 25 to the cover member to provide with said cover member a second part of the housing. An O-ring 27 between the base member and the cover member seals the interior of the housing. The housing is secured to the main casing by screws 28 passing through the base member. For economical manufacture, the wall or enclosure members of the main casing and spring housing, are formed as pressure die castings of a zinc or aluminium alloy, but any of these parts can alternatively be produced as plastic mouldings.

The retaining ring 24 has a part-cylindrical recess 30 that provides an enclosing seating for a worm 32 and the worm engages a series of teeth 34 on peripheral flange 26 of the base member 18, which member thereby forms the wormwheel element of a worm and wormwheel mechanism. The worm is axially retained by abutment with end shoulders 38 of the recess in which it is seated and has a hexagonal socket 40 at one end for an Allen key that can be inserted into an aperture 42 through the end of the recess to rotate the worm. Since the wormwheel element, i.e. the base member 18, is fixed relative to the main casing 2, the rotation of the worm 32 causes it to move around the base member 18 and it carries with it the cover member 20. The outer spring anchorage 22 is thereby displaced to increase or decrease the spring torque, depending upon the direction of movement, and the biasing torque acting on the actuator vane is therefore adjusted. A locking screw 44 is provided to secure the worm in a required position of adjustment.

It will be apparent from the drawings that the wormwheel element engages the worm over an arcuate region that is non-symmetrically offset with respect to the axis of rotation of the wormwheel element. For this, the teeth 34 of the wormwheel element are substantially quadrant form segments extending to a bottom edge or end face 46 that lies in a plane normal to the axis of the shaft 14, said plane containing the axis of the worm 32. This is done to ensure that the tooth form does not have any radial overhang in the region of this terminal edge, so that the die casting (or moulding) for the bottom member can be produced very simply by a two-part mould without requiring separate core members. The configuration may be contrasted with the conventional form of wormwheel tooth which extends symmetrically to each side of a radial plane, i.e., a plane radial with respect to wormwheel axis and containing the worm axis. With the configuration illustrated, the die into which the wormwheel is pressure cast has everywhere a positive draft angle, or at most a zero draft angle at the radially inner end of the teeth. The casting can therefore be ejected from the die in the direction of the wormwheel axis without danger of "drags" or "hang-ups"—i.e. trapping of the casting in the mould due to unintentional undercutting.

It will be understood that simplification of the die casting or moulding process can be obtained also if said terminal edge is above the radial plane through the worm axis, and that it is similarly possible for the tooth form to be extended so that said terminal edge is disposed slightly below that radial plane, provided that in this extension the tooth form does not project or overhang radially outwardly from its minimum radial dimensions relative to the axis of the shaft 14. It may also be noted here that the configuration of the wormwheel teeth that is shown also simplifies assembly, in that the worm and wormwheel elements can be brought into mesh by relative movement of one housing part towards the other in the direction of the axis of wormwheel rotation.

The worm thread can be of generally conventional form but preferably is an Acme profile thread which is slightly modified by being given a root width that is less than half the pitch. The wormwheel teeth are therefore somewhat thicker than the worm thread. This allows for the lesser strength of the die cast or moulded material of the wormwheel element, whereas the worm can be of mild steel. The wormwheel teeth are preferably matched to the pitch of the worm to give a tooth pitch at the middle of the angular extent of the tooth sector, i.e. the pitch of the wormwheel teeth is matched to the worm at a point on the wormwheel teeth where the tooth height extends at some 45°, as measured at the worm axis, from said bottom edge of the tooth segment, i.e. at 45° to the axis of the shaft 14. As illustrated in FIG. 3*a*, this allows the tooth segment to be given the full thickness in its central region with the least amount of taper or cut-away at the ends of the segment.

The driving force of the worm on the wormwheel element will result in a transverse force component reacting on the wormwheel element 18 that will tend to force the teeth 34 away from the worm, i.e. the peripheral flange 26 will tend to be deformed and that portion adjacent the worm will be forced inwards. If this effect is not resisted the teeth 34 can slip out of mesh with the worm 32. The cover member 20 is therefore provided with an inner lip or spigot 50 that has sliding contact with the inner face of the flange 26 of the wormwheel element so as to resist the deformation of the flange due to loading of the teeth 34, and also to guide the rotational movement of the cover member.

The retaining ring 24 is firmly bolted to the cover member 30 in the region of the worm, so that in this region the cover member forms a supporting structure with the retaining ring in the manner of a rigid caliper the jaws of which hold the wormwheel securely in engagement with the worm against the separating force generated by the tooth loading. With the wormwheel tooth geometry already described, this separating force will act substantially in said 45° direction of the axis of the shaft 14, and the line of action therefore extends approximately through the spigot 50 and through the lower part of the radially outer wall of the worm recess 30, i.e. within the supporting jaws. The transverse force on the worm is transmitted through the worm toothing to the wall of the recess 30. Since the worm will only be rotated for adjustment purposes this does not cause undue wear of the retaining ring 24.

It is a feature of the construction described above that adjustment of the spring bias on the actuator vane can be made easily and accurately. The spring can be initially in a zero torque condition when assembled to the main casing and can then be wound to the required setting using the worm and wormwheel mechanism in the manner described. Whenever needed the spring torque can be just as simply altered. These advantages are achieved at relatively low cost, particularly if relatively simple die castings are employed, as described.

The illustrated construction can be modified in many ways within the scope of the invention. For example, the wormwheel element may be arranged on that part of the housing that rotates relative to the casing, or as a separate rotary element within the housing outer walls.

What is claimed is:

1. A pressure-fluid operated actuator comprising a casing, a displacement member in said casing, pivot bearing means between said member and the casing providing a pivot axis for the displacement member, and porting in the casing for a pressure fluid whereby the member is rotatable about said axis under the action of the pressure fluid, a biasing spring connected to the displacement member to return it to an end position from which it can be displaced by said pressure fluid, a housing for said spring comprising two parts that are respectively fixedly secured to the casing and rotationally displaceable relative to the casing about said axis of rotation, the spring having one end fixed to the displacement member and another end fixed to said displaceable housing part for variation of the torque exerted by the spring on the displacement member by rotation of said displaceable part to an adjusted angular position, a worm and wormwheel mechanism for said rotation including a wormwheel element comprising teeth on one of the housing parts and a worm element carried by the other of the housing parts, an arcuate region of the worm element being engaged by the wormwheel teeth, said region being non-symmetrically offset with respect to a plane containing the worm axis and normal to the axis of rotation of said displaceable housing part, the wormwheel teeth for engaging said region of the worm element being formed integrally on its housing part, whereby the worm and wormwheel elements may be brought into mesh by relative movement of the housing parts towards each other in the direction of said axis of rotation, so that said housing parts may, if desired, be of relatively simple die-cast or moulded construction.

2. An actuator according to claim 1 wherein said biasing spring is of spiral form and the wormwheel element of said worm and wormwheel mechanism is coaxial with the pivot axis of the displacement member.

3. An actuator according to claim 1 wherein said other housing part carrying the worm element is the part that is rotatable about the pivot axis of the displacement member.

4. An actuator according to claim 1 wherein said other part of the housing carrying the worm element comprises a supporting portion which at least extends through a region of radial proximity to the worm element, and a portion of said one part of the housing carrying the meshing teeth of the wormwheel element is disposed between the worm element and said supporting portion, whereby said supporting portion supports said portion of said one housing part against deformation by the transverse forces on the wormwheel teeth generated by the reaction between the meshing worm and wormwheel elements.

5. An actuator according to claim 4 wherein said supporting portion is provided by a circumferential shoulder that guides relative rotation between said two housing parts.

6. An actuator according to claim 1 wherein said other housing part carrying the worm element comprises an annular member provided with a locating recess for the worm element and a further member having a portion abutting said annular member, clamping means securing said two housing part members together, said one housing part comprising the wormwheel element having a rim portion engaged between said two housing part members and providing location and guide means for the relative rotation between the housing parts.

7. An actuator according to claim 1 wherein the housing part comprising the wormwheel element is a die-cast part.

8. An actuator according to claim 1 wherein the wormwheel element teeth are disposed substantially wholly to one side of a plane that is normal to the displacement member pivot axis and that contains the rotary axis of the worm element.

9. An actuator according to claim 1 wherein the individual wormwheel teeth extend over substantially a quadrant relative to the worm element axis.

10. An actuator according to claim 9 wherein the tooth height at the centre of said angular extent projects at substantially 45° to the wormwheel axis.

11. A pressure-fluid operated actuator comprising a casing, a displacement member in said casing, pivot bearing means between said member and the casing providing a pivot axis for the displacement member, and porting in the casing for a pressure fluid whereby the member is rotatable about said axis under the action of the pressure fluid, a spiral spring having one end connected to the displacement member to bias it to an end position, and a worm and wormwheel mechanism mounted on the casing connected to the other end of the spring for varying the biasing torque by movement of said other end of the spring about the pivot axis, said mechanism comprising a wormwheel element disposed coaxially to said pivot axis and a worm element having an axis normal to but radially spaced from said pivot axis, the wormwheel element having teeth that are offset with reference to a plane normal to the pivot axis containing said worm element axis, said wormwheel teeth having one end terminating near said normal plane.

* * * * *